United States Patent [19]

Kobayashi et al.

[11] 4,447,370

[45] May 8, 1984

[54] SUPPLEMENTARY FUEL SUPPLY MECHANISM FOR INTERNAL COMBUSTION ENGINES

[75] Inventors: Hiroto Kobayashi; Takeshi Kobayashi, both of Kawasaki, Japan

[73] Assignee: Walbro Far East, Inc., Kawasaki, Japan

[21] Appl. No.: 390,388

[22] Filed: Jun. 21, 1982

[30] Foreign Application Priority Data

Jul. 13, 1981 [JP] Japan ..... 56-108134

[51] Int. Cl.³ ..... F02M 1/16

[52] U.S. Cl. ..... 261/35; 261/DIG. 68; 261/DIG. 8; 261/121 A

[58] Field of Search ..... 261/DIG. 8, 39 D, 121 A, 261/DIG. 68, 35, 34 R

[56] References Cited

U.S. PATENT DOCUMENTS

| | | | |
|---|---|---|---|
| 817,641 | 4/1906 | Harris | 261/DIG. 8 |
| 1,183,183 | 5/1916 | Funderburk | 261/DIG. 8 |
| 1,408,277 | 2/1922 | Ensign | 261/DIG. 8 |
| 1,816,756 | 7/1931 | Whatmough et al. | 261/121 A |
| 2,074,471 | 3/1937 | Holley et al. | 261/39 D |
| 2,754,094 | 7/1956 | Mennesson | 261/39 D |
| 2,985,159 | 5/1961 | Moseley | 261/39 D |
| 3,346,245 | 10/1967 | Mennesson | 261/39 D |
| 3,767,173 | 10/1973 | Ishii | 261/DIG. 8 |
| 4,228,110 | 10/1980 | Magnet | 261/DIG. 8 |
| 4,335,061 | 6/1982 | Kobayashi | 261/DIG. 8 |

FOREIGN PATENT DOCUMENTS

| | | | |
|---|---|---|---|
| 55-142951 | 7/1980 | Japan | 261/DIG. 8 |

*Primary Examiner*—Tim R. Miles

*Attorney, Agent, or Firm*—Barnes, Kisselle, Raisch, Choate, Whittemore & Hulbert

[57] ABSTRACT

A supplementary fuel supply mechanism for internal combustion engines which is incorporated in a carburetor with a manually operated flexible dome to discharge fuel from a supplemental fuel chamber adjacent the air inlet of a carburetor. The device is designed so that it can be interposed between the carburetor body and the air inlet as an auxiliary unit optionally applied.

7 Claims, 3 Drawing Figures

SUPPLEMENTARY FUEL SUPPLY MECHANISM FOR INTERNAL COMBUSTION ENGINES

FIELD OF INVENTION

A primer device for providing supplemental fuel to a carburetor air passage to make starting of an engine easier particularly in cold weather.

BACKGROUND AND OBJECTIONS OF THE INVENTION

This invention relates to supplementary fuel supply device, which can be incorporated into a carburetor, to promote starting efficiency of, for example, a two-cycle engine used as a power source for chain saws or lawn mowers. A standard carburetor mounted on an internal combustion engine has a fuel supply device built in therewith in order to supply proper amounts of fuel to said engine in accordance with its operating condition. However, in cold weather or in other conditions, the amount of fuel supplied from only said fuel supply device presents a problem in engine starting efficiency.

It has been previously suggested to provide a cavity opening in said air intake passage between the carburetor and the air intake orifice of the internal combustion engine to retain a sufficient amount of supplementary fuel necessary for engine starting. In this system, as the engine is about to start, the retained fuel in the cavity simultaneously flows into the engine because of the suction in the air supply passage and this increases the fuel mixture strength for the starting of the engine.

However, in order to maintain smooth idling of the engine immediately after its starting, it is desirable to keep supplying high mixture concentration to the engine continuously even after the starting. To satisfy this demand, it is conceivable that said cavity should be designed with a sufficient capacity to be able to hold a proper amount of supplementary fuel in the cavity for the idling run.

However, the fact that the fuel cavity is open to the air intake passage makes it possible that a large amount of supplementary fuel in the cavity may prevent the starting of the engine because of improper atomization of the supplementary fuel in the cavity flowing into the air intake passage. This may occur as a result of a slight vibration at the starting of the engine or from the tilt attitude of the carburetor, and it is feared that engine starting could be hampered because of flow of the supplementary fuel in liquid form into the engine.

In view of the foregoing, it is a general object of this invention to provide a supplementary fuel supply device that will not interfere with the engine starting, and yet retains sufficient amount of supplemetary fuel to supply the quantity needed for said engine starting and a sufficient supply for the subsequent idling run in quantities which can be satisfactorily handled by the engine.

The features of this invention are as follows: to provide a supplementary fuel retainer chamber independently of the air intake passage that connects to the air inlet through the carburetor; to provide a piloting means in said retainer chamber for piloting the retained fuel in said retainer chamber into said air intake passage; and to provide an air vent in the retainer chamber for supplying supplementary fuel of said retainer chamber into said air intake passage by suction of said air intake passage. With the foregoing method, supplementary fuel will not flow in objectionable quantities into the air intake passage either as a result of vibration or slight tilt attitude, and yet a sufficient amount of supplementary fuel can be provided for the idling stage of the engine.

Other features of the invention will be apparent in the following description and claims in which the invention is described, together with details to enable one skilled in the art to practice the invention.

BRIEF DESCRIPTION OF THE INVENTION

The above-mentioned supplementary fuel mechanism includes a tubular component that has an orifice at the tip to introduce the supplementary fuel supply to the air-fuel passage of a carburetor. The tubular component has an air bleed orifice open to a retainer chamber near the tip end of the tubular component in which said fuel orifice is located.

The retainer chamber is provided with an internal chamber partitioned from said retainer chamber which functions cooperatively with said tubular component and its surrounding circumferential wall component. The tubular component has a connecting orifice that opens to the retainer chamber near the end of the tubular component opposite to where the tip orifice is located. The circumferential wall component has an air bleed orifice open to the retainer chamber near the tip end of said tubular component where said fuel orifice is located. The retainer chamber may have an ejection port for an excess amount of supplementary fuel transfused through said fuel transfusing device for the purpose of retaining a prescribed amount of fuel in the chamber. The supplementary fuel supply device is made as a unit which can be mounted in between the carburetor and an air cleaner and joined therewith.

BRIEF DESCRIPTION OF THE DRAWINGS

Drawings accompany the disclosure and the various views thereof may be briefly described as.

DETAILED DESCRIPTION OF THE INVENTION AND THE MANNER AND PROCESS OF USING IT

Figure 1:
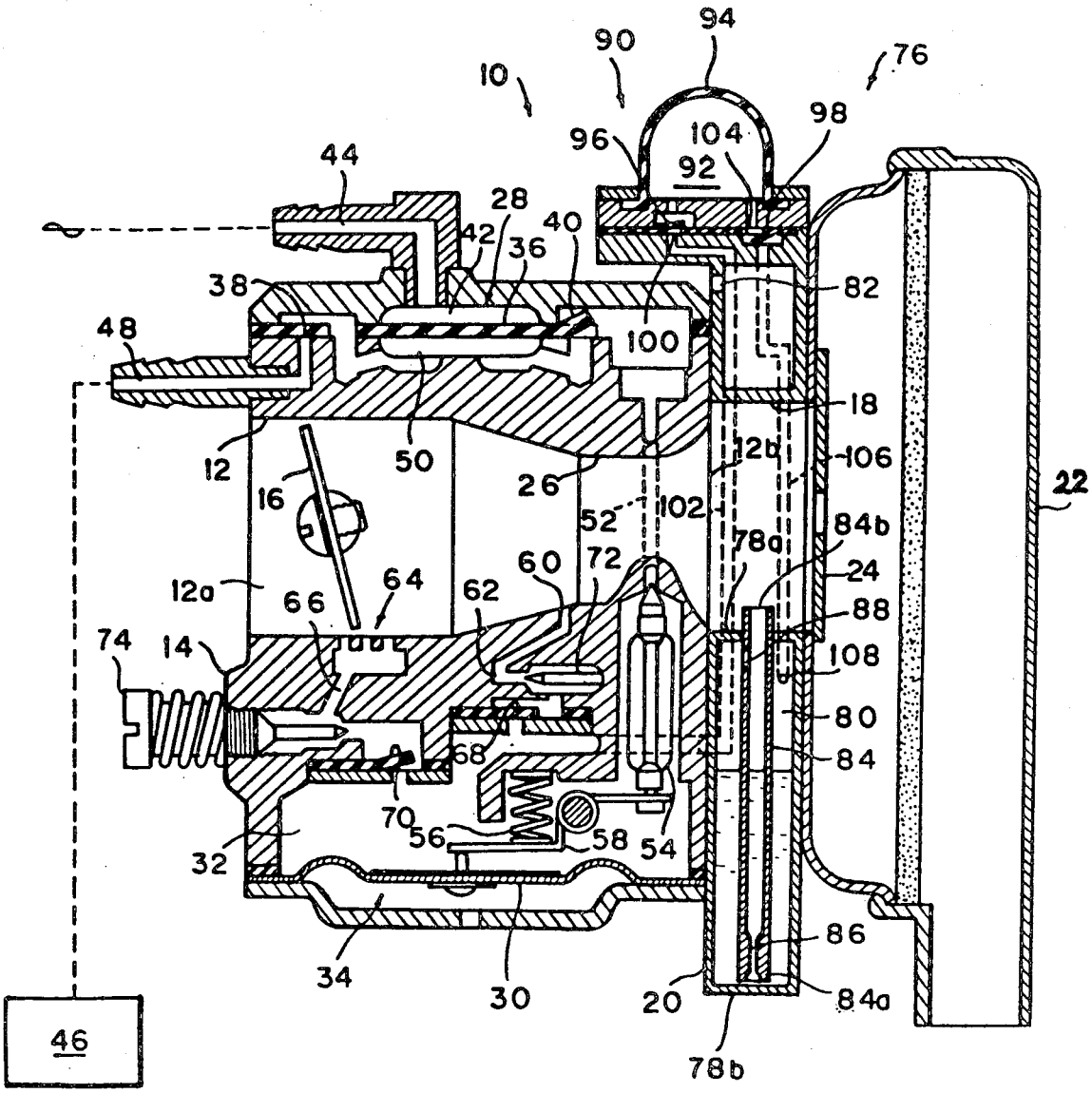
FIG. 1, a sectional view of a carburetor incorporating the supplementary fuel supply.

The carburetor 10, in relation to this invention as viewed in FIG. 1, includes carburetor body 14 with air orifice or mixing passage 12 and throttle valve 16 variable according to the effective diameter of the air orifice 12 as shown in FIG. 1 of the drawing. One end of 12*a* of the air orifice 12 is connected to an air intake orifice of an internal combustion engine through an air intake duct (not shown), for example, or to an air intake orifice of a two-cycle engine. The other end 12*b* is connected to air cleaner 22 through the housing 20 which is provided with the orifice 18 adjustable to fit the air orifice 12. The air cleaner 22, as shown in the example of the drawing, is provided with a choke valve 24 and venturi 26 is provided with air cleaner 22 located upstream of the throttle 16 in the air orifice 12. The air intake passage comprises orifice 18, air orifice 12, and the air intake duct.

The carburetor body 14 is provided with fuel pump 28 and fuel supply device 34 as has been well known, which has a diaphragm chamber 32, one wall of which is diaphragm 30.

Fuel pump 28 is a diaphragm pump comprising a diaphragm 36 and a pair of check valves 38 and 40. Working pressure from the pulse of an engine, for instance, the crank chamber pressure of a two-cycle engine, is introduced through the opening 44 into the diaphragm chamber 42 to one side of diaphragm 36. Therefore, in the operating condition of said engine, the fuel pump 28 sucks fuel from a fuel tank 46 into the pump chamber 50 on the other side of diaphragm 36 through the opening 48 as has been well known. This fuel will be moved to the diaphragm chamber 32 through passage 52.

The diaphragm chamber 32 is provided with a fuel inlet valve 54 to intermittently connect passage 52 with chamber 32. Valve 54 is connected with diaphragm 30 by a swing lever 58 working from spring action of the compression spring 56. A main fuel passage 62 is open to the fuel and air passage 12 near venturi 26 at the main port 60. Another idle fuel passage 66 opens to passage 12 near the throttle valve 16 and ends at plural idling ports 64 respectively extended from diaphragm chamber 32. Check valves 68 and 70 prevent air flow toward diaphragm chamber 32 in primer operation (which will be described later), and adjusting screws 72 and 74 control fuel, respectively, at each passage 62 and 66.

When operating said engine after warming up, fuel in diaphragm chamber 32 will be sucked in by the air induction passage 12 through each port 60 and 64 in response to operating conditions which affect the suction in the air induction passage 12.

While the valve 54 is in motion, opening and closing, by suction from diaphragm chamber 32, it serves to provide the prescribed amount of fuel in diaphragm chamber 32. Thus, the engine operation, after warming up, will be kept ideal and under control in the usual manner. However, it is impossible to supply sufficient fuel mixture to promote efficiency of engine starting, and also to maintain ideal idling conditions after starting by only the fuel supplied from the normal supply device 34.

In view of the above fact, the supplementary fuel supply device 76, according to the present invention, is added to the housing unit 20 and arranged between carburetor 10 and air cleaner 22. Housing 20 is made in a ring shape to provide the orifice 18. The housing 20 is provided with supplementary fuel supply retainer chamber 80 independent of orifice 18 and is partitioned off from said orifice 18 by interior circumferential wall **78*a*, inside of which the orifice 18 is provided. This retainer chamber 80 opens to atmosphere at the upper portion through air vent 82 of the housing 20**.

The retainer chamber 80 is provided with a tubular part 84 that pilots supplementary fuel in said retainer chamber into orifice 18 which becomes an integral part of said air intake passage. One end **84*a* of the tubular part 84 is arranged at the bottom of said retainer chamber 80, that is, next to the outer circumferential wall and extends in the direction of the diameter of the orifice 18 facing toward the air vent 82 in an exterior wall of the housing 20. The other end 84*b* of the tubular part 84 penetrates the interior circumferential wall 78*a* and protrudes into the orifice 18. The outer end 84*a* of the tubular part 84 is provided with an orifice 86 and the tubular part 84, via said orifice, opens to the bottom of said retainer chamber 80. In addition, near the other end 84*b* of the tubular part 84 an air bleed 88 is provided which opens to the retainer chamber 80**.

The retainer chamber 80 receives supplementary fuel supply through the fuel supply device 90 which is fixed onto the housing 20.

According to an example in FIG. 1 of the drawings, the fuel supply device 90 is a hand pump provided with a pair of check valves 96 and 98. A cap-shaped resilient dome 94 controls pump chamber 92 while the inlet opening 100 of the pump chamber 92, where check valve 96 is located, is connected with said diaphragm chamber 32 via the inlet opening passage 102. An exhaust port 104 of the pump chamber 92, where the other check valve 98 is located, opens into said retainer chamber 80 via exhaust passage 106. The entrance to the supplementary fuel retainer chamber 80 for this exhaust passage 106 is at 108.

The pump 90 of said supplementary fuel supply device 76 is manually operated prior to starting of said engine. In this manual operation, as the resilient dome 94 of pump 90 gets repeatedly pressed, negative pressure works from suction of pump dome 94 and pump 90 so that fuel in pump 28 and in fuel tank 46 will be drawn into the diaphragm chamber 32 via pump chamber 50 of pump 28. This performance is carried out despite the non-operation of the engine, that is, despite the non-operation of the fuel pump 28.

As described above, the pump 90 functions as a suction primer pump. As diaphragm chamber 32 fills up with fuel by repeated action of pump 90, the sucked fuel will be transferred to supplementary fuel retainer chamber 80 from suction passage 102 through pump chamber 92 and exhaust passage 106. Thus, a prescribed amount of supplementary fuel is held in said retainer chamber 80. The fuel level in said retainer chamber 80 stays below air bleed 88 of said tubular part 84.

Subsequently, the engine will get started by starter recoil action. When a choke valve 24 is available, it is desirable to operate it at the closed position, as indicated in FIG. 1, prior to starter recoil action.

In trying to start up the engine in a condition holding the throttle valve 16 at the idling position, fuel will be sucked into said air intake passage from the idling port 64 of said fuel supply device 34 by suction negative pressure working in said air intake passage. In addition to this fuel from the idle ports, fuel in the tubular part 84 of the supplementary fuel supply device 76 will also be sucked into said air intake passage through orifice **84*b*** by said suction negative pressure. As a result, fuel mixture strength during the engine starting is increased. This enables easy starting at the idling position of said engine.

The air bleed 88 cannot function in respect to promoting atomization of supplementary fuel in said tubular part 84 when starting said engine, but it is desirable to provide the air bleed 88.

In idling operation subsequent to said engine start, supplementary fuel in said retainer 80, atomization of which is promoted by means of orifice 86 of said tubular part 84, in regular sequence will be sucked into said air intake passage via said tubular part 84. Following the progress of the idling operation, supplementary fuel level in said retainer chamber 80 decreases and the amount of supplementary fuel supply from said tubular part 84 equally decreases. As the result, fuel-air mixture to be supplied to said engine ideally runs to lean. This enables the engine to maintain smooth idling operation even in cold weather.

Supplementary fuel supply stops after consumption of the supplementary fuel in said retaining chamber 80, or by way of opening choke valve. However, because of the fact that said chamber 80 can retain a comparatively large amount of fuel, a suitable amount of supplementary fuel can be successfully supplied at the engine starting and during subsequent idling operation.

Another merit is that by way of leaving the fuel in said retainer chamber 80 after idling operation, such remaining fuel can be utilized as the supplementary fuel when accelerating.

Figure 2:
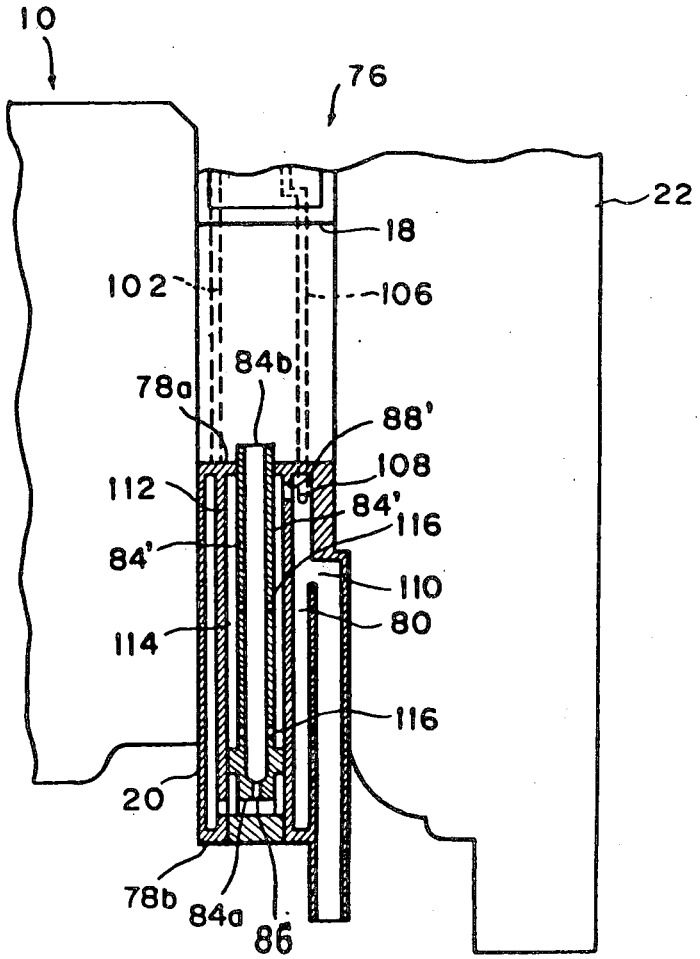
FIG. 2, a partial section showing a modified supplementary fuel apparatus.

According to the example shown in FIG. 2 of the drawing, there is shown a modified means of piloting supplementary fuel from the retainer chamber 80 into the air intake passage. Below the orifice 18, a chamber 114 can be formed between a circumferential wall part 112 and the tubular part 84' in the retainer chamber 80. By providing circumferential wall part 112 with space in between and encircling similar part 84', as described above, the chamber 114 is created. This chamber is connected to the inside of the tubular part 84' via the orifices 116 respectively which are located at the center part of the tubular part 84' and also near the lower end where the orifice 86 is located.

An air bleed 88' is located near the upper end **84*b* of the tubular part 84; on the circumferential wall part 112 and above an exhaust or ejection port 110** which opens to a downwardly extending tube outlet suitably discharged to a tank.

By arranging chamber 114 on the exterior of circumference of the tubular part 84' partitioned and connected with the interior of the tubular part 84' via said orifices 116, then fuel of both the tubular part 84' and the chamber 114 can be supplied for engine starting. With this arrangement, starting efficiency can be even more improved. At the same time, a suitable decrease of mixture concentration can be achieved during the idling operation.

As another modification, instead of having the supplementary fuel supply device 76 attached to the housing 20, for example, the retainer chamber 80 can be formed on the carburetor body 14. By means of securing sufficient capacity in said retainer chamber 80, together with the structural simplification purpose, as described above, it may be desirable to have it built into the housing 20. Of course, in the embodiment described in FIGS. 1 and 2, by making the supplementary fuel supply device as a housing unit, mountable in between a carburetor body and an air cleaner, and by merely making partial alterations to the suction air passage 102 of pump 90 to the chamber 32, the device can be added to a carburetor which has no supplementary fuel supply device. This method is extremely advantageous for manufacturing process.

Figure 3:
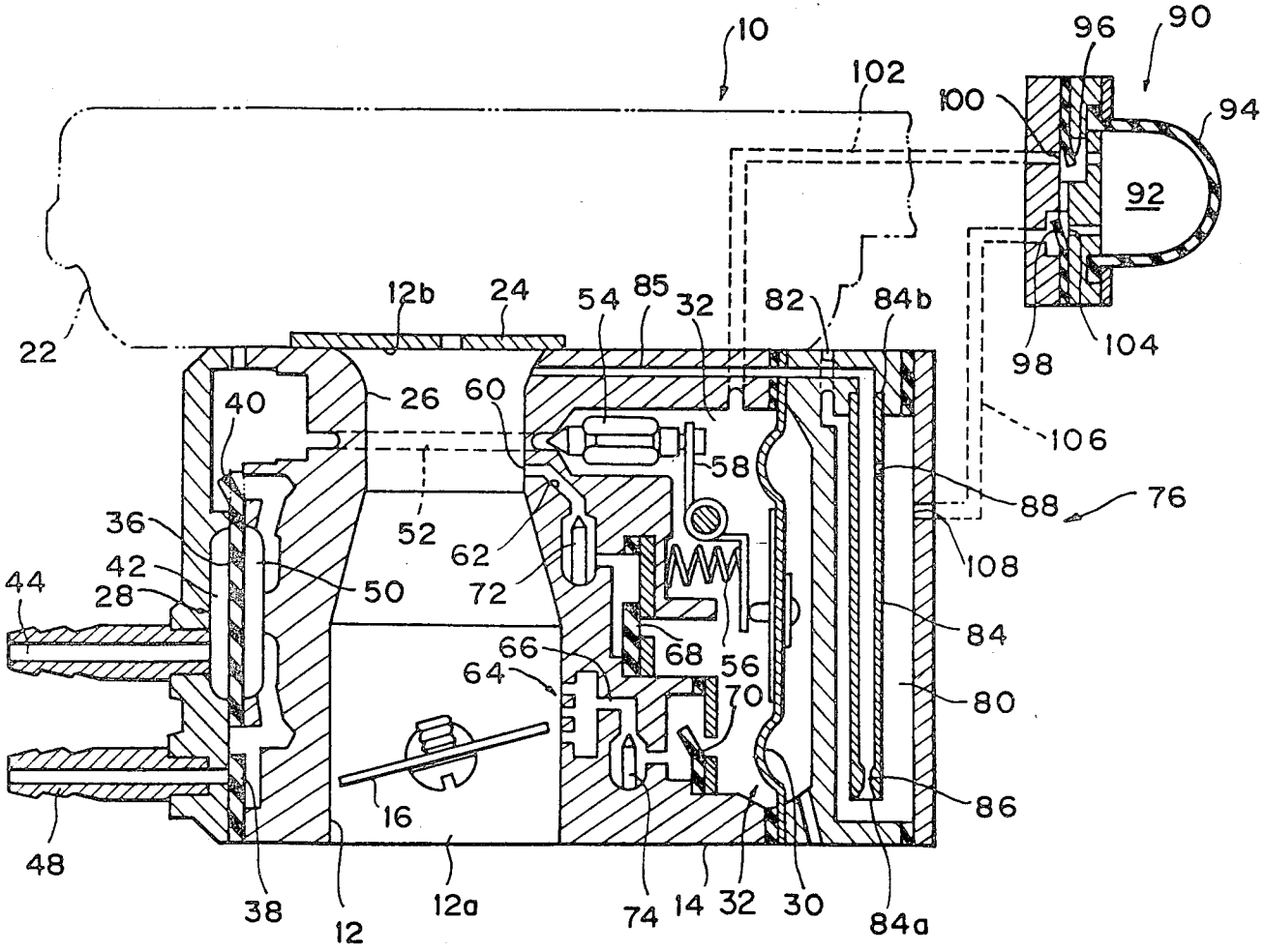
FIG. 3, a sectional view of a carburetor incorporating the supplementary fuel supply in an embodiment differing from FIG. 1.

FIG. 3 shows an example in which the supplementary fuel supply device 76 according to this invention is provided on the diaphragm chamber 32. In the example shown in FIG. 3, the reference numbers are corresponding to ones in FIG. 1 with regard to each function of component parts. The one end **84*b* of the tubular part 84 opens to the air induction passage 12 through the piloting passage which is provided within the carburetor body 14, instead of directly opening to the air induction passage 12**.

As described above, the example embodied relates to the suction primer pump 90 utilized as a fuel transfusing device for the supplementary fuel supply device in this invention. In lieu of this pump, other equivalent devices can be used, and also said supplementary fuel transfusing device can be provided separately rather than being built in to the housing 20.

In accordance with this invention, as described above, a comparatively large amount of fuel, as supplemental, can be retained without letting it flow out in the suction air passage of engine by engine starting vibration or in its tilt attitude. The retained supplementary fuel will be furnished to the engine during the engine starting and during the idling operation. Consequently, this method enables easy starting of said engine in cold weather with the idle setting of the throttle valve, and assures smooth idling operation following the starting.

The supplementary fuel supply device according to this invention can also be applied to a diaphragm type carburetor utilizing a rotary throttle valve and to a float type carburetor respectively.

We claim:

1. A device which supplements the fuel supply for the starting and idle operation of an internal combustion engine and to be utilized in conjunction with a carburetor having a fuel chamber, a fuel and air mixing passage with an air inlet at one end and an engine outlet for fuel and air at the other end for supplying fuel to an engine during normal operation thereof which comprises:

(a) first means forming a supplemental fuel chamber adjacent the air inlet of a carburetor, (b) orifice means in said supplemental fuel chamber opening to the air inlet of a carburetor to admit liquid fuel to said air inlet, (c) third means to supply fuel to said supplemental fuel chamber, (d) said first means comprising a housing forming an annular hollow chamber having an opening to register with the air inlet of said carburetor, and (e) said orifice means comprising a tubular element radially disposed in said annular hollow chamber and having an open end forming a fuel orifice extending into said opening and a second open end communicating with the interior of said chamber.

2. A device to supplement fuel supply to an internal combustion engine as defined in claim 1 in which said third means comprises a manually operable pump having an inlet connected to said carburetor fuel chamber and an outlet connected to said annular hollow chamber.

3. A device to supplement fuel supply to an internal combustion engine as defined in claim 1 in which said third means comprises a manually operable pump mounted on said annular chamber having an inlet connected to said carburetor fuel chamber and an outlet connected to said annular hollow chamber.

4. A device to supplement fuel supply to an internal combustion engine as defined in claim 1 in which said annular chamber is mounted on a carburetor adjacent the air inlet, and an air filter is mounted on said chamber having an aperture registering with said opening.

5. A device to supplement fuel supply to an internal combustion engine as defined in claim 1 in which an air bleed orifice is provided in said tubular element opening to said chamber adjacent the fuel orifice end of said element.

6. A device to supplement fuel supply to an internal combustion engine as defined in claim 1 in which said third means comprises a manually operated pump having a base plate mounted on said annular chamber housing, an inlet opening in said base plate communicating with a fuel chamber of said carburetor, an outlet opening in said base plate communicating with said annular chamber, a top plate on said base plate having inlet and outlet openings registering with similar openings in said base plate, a compressible hollow dome sealed on said top plate, and a valve diaphragm captured between said plates having a unidirectional valve in said inlet openings to admit fuel to said dome when the dome is expanded, and a unidirectional valve in said outlet openings to admit fuel to said annular chamber when said dome is depressed.

7. A device to supplement fuel supply to an internal combustion engine as defined in claim 6 in which an exhaust opening is provided in said annular elongate chamber spaced upwardly relative to said second opening of said tubular element to limit the amount of fuel in said chambers.

* * * * *